US009371179B2

(12) United States Patent
Miller et al.

(10) Patent No.: US 9,371,179 B2
(45) Date of Patent: Jun. 21, 2016

(54) COLLAPSIBLE NESTABLE CONTAINER

(71) Applicant: Buckhorn Inc., Milford, OH (US)

(72) Inventors: Daniel R. Miller, Cincinnati, OH (US); Anthony P. Habodasz, Troy, OH (US)

(73) Assignee: BUCKHORN, INC., Milford, OH (US)

( * ) Notice: Subject to any disclaimer, the term of this patent is extended or adjusted under 35 U.S.C. 154(b) by 0 days.

(21) Appl. No.: 14/156,498

(22) Filed: Jan. 16, 2014

(65) Prior Publication Data

US 2014/0197168 A1 Jul. 17, 2014

Related U.S. Application Data

(60) Provisional application No. 61/753,485, filed on Jan. 17, 2013, provisional application No. 61/787,483, filed on Mar. 15, 2013.

(51) Int. Cl.
*B65D 88/52* (2006.01)
*B65D 19/18* (2006.01)

(52) U.S. Cl.
CPC ..... *B65D 88/528* (2013.01); *B65D 19/18* (2013.01); *B65D 2519/008* (2013.01); *B65D 2519/00034* (2013.01); *B65D 2519/00069* (2013.01); *B65D 2519/0084* (2013.01); *B65D 2519/00129* (2013.01); *B65D 2519/00174* (2013.01); *B65D 2519/00208* (2013.01); *B65D 2519/00273* (2013.01); *B65D 2519/00288* (2013.01); *B65D 2519/00323* (2013.01); *B65D 2519/00338* (2013.01); *B65D 2519/00452* (2013.01); *B65D 2519/00497* (2013.01); *B65D 2519/00567* (2013.01); *B65D 2519/00587* (2013.01); *B65D 2519/00641* (2013.01); *B65D 2519/00711* (2013.01)

(58) Field of Classification Search
CPC ..... B65D 88/528
USPC ..... 220/4.33, 4.28, 62.11, 666, 6, 7, 639, 220/645, 646, 651; 206/503, 508, 509, 511, 206/505, 514, 600
See application file for complete search history.

(56) References Cited

U.S. PATENT DOCUMENTS

| | | | | | |
|---|---|---|---|---|---|
| 2,525,838 | A * | 10/1950 | Smith et al. | 217/16 |
| 2,579,655 | A * | 12/1951 | Donald | 220/6 |
| 2,717,716 | A * | 9/1955 | Farrar | 220/6 |
| 3,371,816 | A * | 3/1968 | Ricci | 220/4.28 |
| 4,809,851 | A * | 3/1989 | Oestreich et al. | 206/599 |
| 5,253,763 | A * | 10/1993 | Kirkley et al. | 206/600 |
| 5,381,915 | A * | 1/1995 | Yardley | 220/4.33 |
| 5,555,980 | A * | 9/1996 | Johnston et al. | 206/600 |
| 6,170,689 | B1 * | 1/2001 | Flesher et al. | 220/7 |
| 7,416,092 | B2 * | 8/2008 | Dubois et al. | 220/6 |
| 8,408,411 | B2 * | 4/2013 | Hay et al. | 220/4.29 |
| 2005/0224494 | A1 * | 10/2005 | Heinrichs | 220/4.28 |
| 2008/0169284 | A1 * | 7/2008 | Haimoff et al. | 220/4.28 |
| 2009/0127158 | A1 * | 5/2009 | Apps | 206/600 |
| 2013/0081971 | A1 * | 4/2013 | Ritzberger et al. | 206/511 |

* cited by examiner

*Primary Examiner* — Jeffrey Allen
*Assistant Examiner* — Jennifer Castriotta
(74) *Attorney, Agent, or Firm* — Benesch, Friedlander, Coplan & Aronoff LLP

(57) ABSTRACT

A collapsible nestable container is provided. The collapsible nestable container may comprise a plurality of panels, each having one or more locking features that interlock with the locking features of the other panels to form an assembled container. The panels further comprise one or more nesting features, that interlock with the nesting features of the other panels to allow the panels to nest in a collapsed configuration with similar or dissimilar panels.

15 Claims, 16 Drawing Sheets

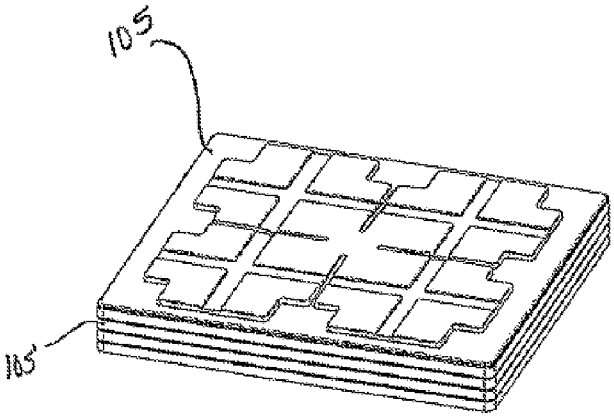
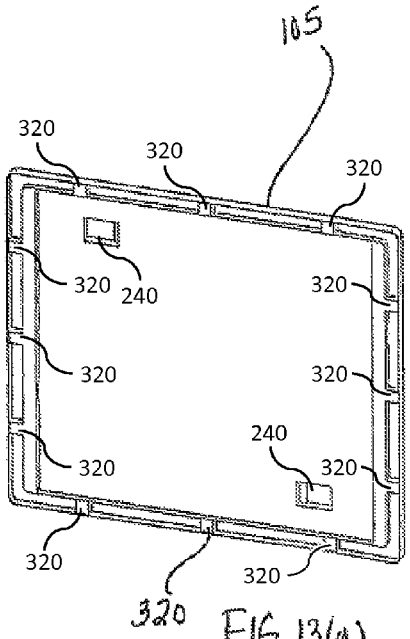
FIG. 13(a)
FIG. 13

COLLAPSIBLE NESTABLE CONTAINER

RELATED APPLICATIONS

This application claims priority to U.S. Provisional Patent Application No. 61/753,485, filed on Jan. 17, 2013 and U.S. Provisional Patent Application No. 61/787,483, filed on Mar. 15, 2013.

FIELD OF INVENTION

The present disclosure relates to collapsible storage containers. More particularly, the present disclosure relates to a collapsible nestable container for use in storing and transporting liquids.

BACKGROUND

Collapsible containers are used in the food shipment industry. The containers typically include six panels that form a cube-like structure when assembled. Traditionally, the panels are made from wood and are not easily returned in an collapsed configuration and are not designed for ease of transport while in the collapsed configuration. In addition, the wood allows bacteria to build up on the insides of the containers, absorbs water and algae, and requires the use of nails, making sanitization of the containers difficult, if not impossible, and making it likely that the plastic bags that hold the product inside of the containers would be punctured or damaged during use. It would be beneficial to have a container made of plastic that was easily collapsible, nestable, and easily cleaned and sanitized.

SUMMARY

In one embodiment, a collapsible nestable container is provided, the collapsible nestable container includes a plurality of panels that can be assembled to form a container. The plurality of panels each include at least one locking feature that is configured to mate with one or more locking features of one or more of the other panels when in the assembled configuration, forming a locking connection thereto. The plurality of panels further include at least one nesting feature that is configured to mate with at least one nesting feature of at least one other panel in a nested configuration to form a connection that prevents the panels from moving significantly while in the nested configuration.

BRIEF DESCRIPTION OF THE DRAWINGS

In the accompanying drawings, structures are illustrated that, together with the detailed description provided below, describe exemplary embodiments of the claimed invention. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

FIG. 13 is a perspective view of four lid panels nested with each other.

FIG. 13*a* is a perspective view of a bottom surface of a lid panel.

DETAILED DESCRIPTION

Figure 1:
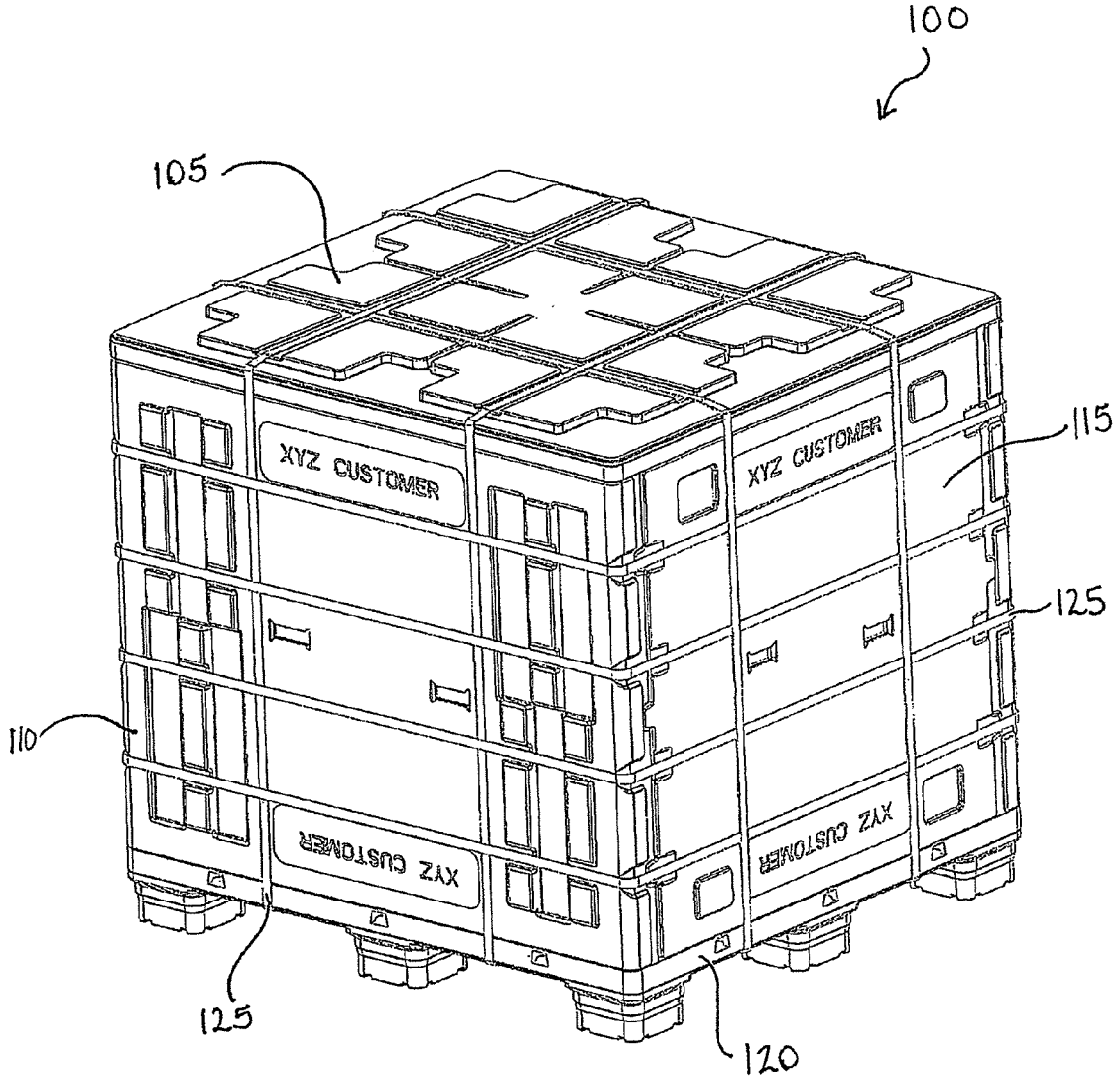
FIG. 1 is a perspective view of one embodiment of an assembled collapsible nestable container.

FIG. 1 illustrates a perspective view of one embodiment of a collapsible nestable container 100 (hereinafter "the container") having a lid panel 105, two support panels 110, two flat panels 115, and one base 120 in an assembled configuration. In this embodiment, the base 120 provides support for the two support panels 110 and the two flat panels 115. The support panels 110 and flat panels 115 form the walls of the container 100 when in an assembled configuration. The lid panel 105, support panels 110, flat panels 115, and the base 120 may be made of plastic or other suitable material. In one embodiment, all of the components may be injection molded so that all of the surfaces that are exposed to the contents of the container are smooth and are generally free from sharp edges, splinters, nails, or other unwanted protrusions or crevices.

Once assembled, bands 125 may be wrapped about the container 100 along the vertical and horizontal planes. The bands 125 maintain the container 100 in the assembled configuration during transport and storage of the contents. The bands 125 may be comprised of metal or other suitable material. It is anticipated that other mechanisms may be used to provide additional support to the assembled container 100 instead of or in conjunction with the bands 125, including but not limited to mechanical fasteners such as nails, screws, bolts, etc. or chemical fasteners such as adhesives, welds, etc. It is also contemplated that the container 100 may be assembled and used without the bands 125.

In other embodiments, the container may include more or less than two support panels 110 and two flat panels 115. Different numbers of panels may be used to form a differently shaped assembled containers without departing from the scope of the present invention. Additionally, the panel labels of "lid," "support," "flat," and "base" are merely used as terms of convenience, and are not intended to limit the panels to any particular orientation or shape. When the collapsible nestable container is configured in assembled form, it may be used to store or transport any number of items, including both perishable and non-perishable products such as tomato paste.

Figure 2:
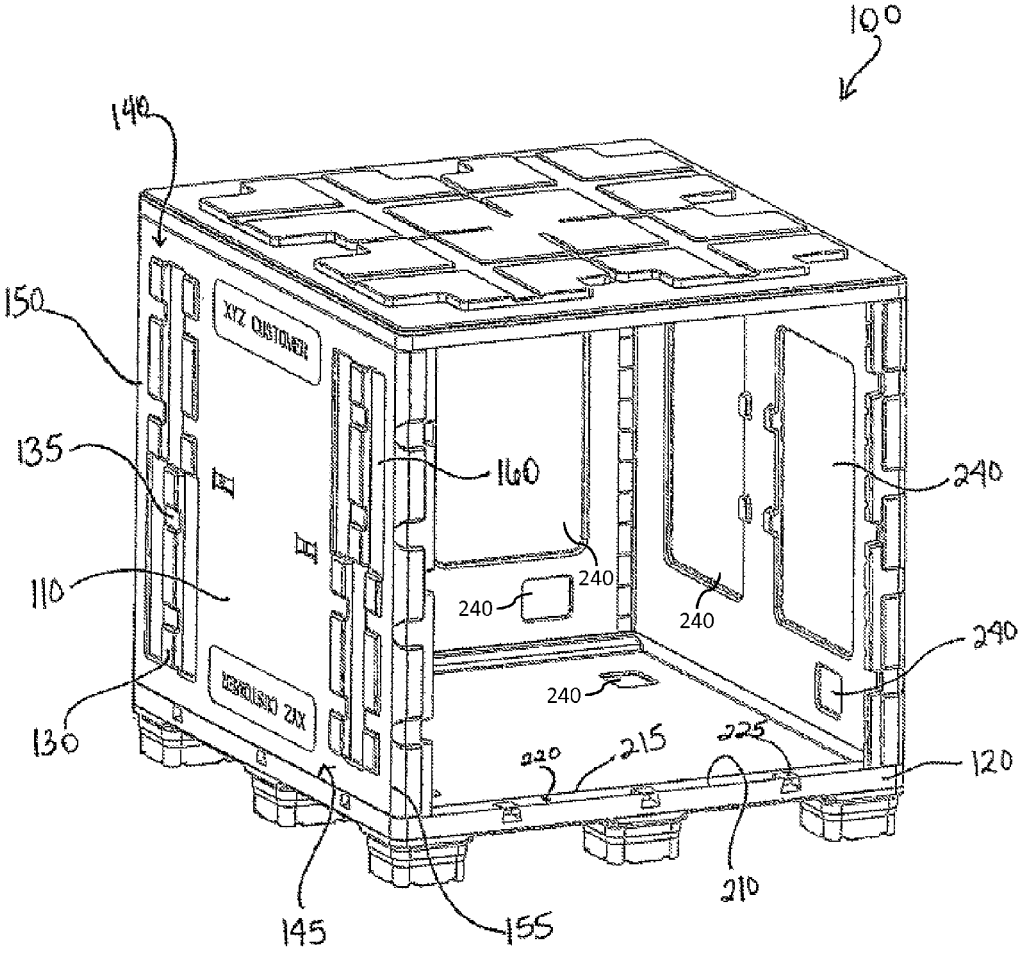
FIG. 2 is a perspective view of one embodiment of an assembled collapsible nestable container with one panel removed.

As shown in FIG. 2, which illustrates a perspective view of one embodiment of the container 100 with one flat panel 115 removed to provide an interior view, the container 100 may include at least two support panels 110. The outer surface of each support panel 110 may include nesting protrusions 130 that extend outwardly therefrom.

Generally, the nesting protrusions 130 are configured about the outer surface in a pattern that creates banding recesses 135 capable of receiving the bands 125 (as shown in FIG. 1) when the container 100 is assembled and nesting recesses 160 capable of receiving the nesting protrusions 130 when the support panels 110 are in a collapsed and nested position.

Figure 6:
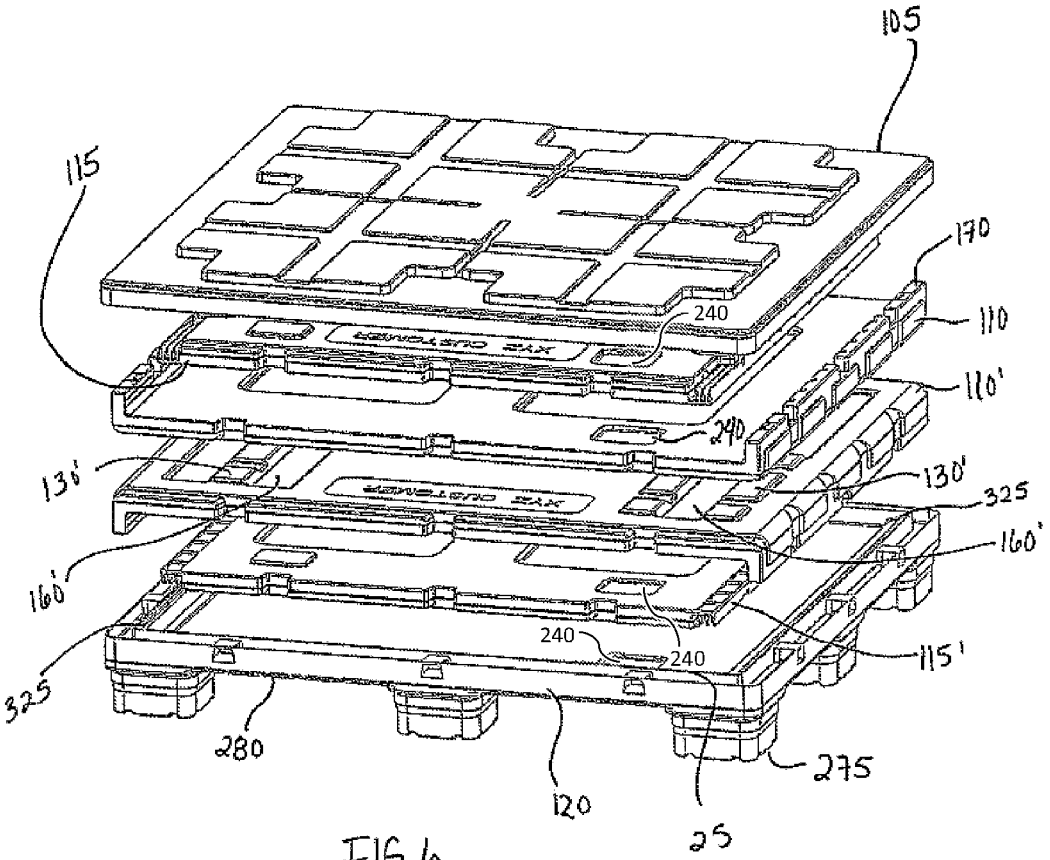
FIG. 6 is an exploded view of the embodiment shown in FIG. 4.

As shown in FIG. 2, in one embodiment, each support panel includes a plurality of the nesting protrusions 130 that are generally rectangular in shape and extend perpendicularly between a top portion 140 of the support panel 110 and a bottom portion 145 of the support panel 110. In one embodiment, the nesting protrusions 130 may be aligned in single or double vertical columns along a first vertical side 150 of the support panel 110 and in single or double vertical columns on a second vertical side 155 of the support panel 110. Generally, the alignment of the nesting protrusions 130 enables a first support panel 110 to nest with a second support panel 110', as shown in FIG. 6, and prevents the support panels 110 from moving relative to one another in either the horizontal or vertical direction when nested. In other embodiments, the nesting protrusions 130 may be arranged in any configuration, and may be provided in any number or shape without departing from the scope of the present invention.

As shown in FIG. 2, the nesting recesses 160 run parallel to the array of nesting protrusions 130. In one embodiment, the nesting recesses 160 are located on either side of the arrays of nesting protrusions 130. It is anticipated that other configurations and numbers of nesting protrusions 130 and nesting recesses 160 may be used without departing from the scope of the present invention.

As discussed above, the support panels 110 may include banding recesses 135 disposed horizontally between each nesting protrusion 130. The banding recesses 135 may be configured to receive the bands 125 so that the bands 125 remain in direct contact with the outer surface of support panels 110, reducing the chances that an affixed band 125 will be snagged by machinery, slip from position, or be broken when the outer surface of the container 100 contacts or hits another hard surface.

Figure 3:
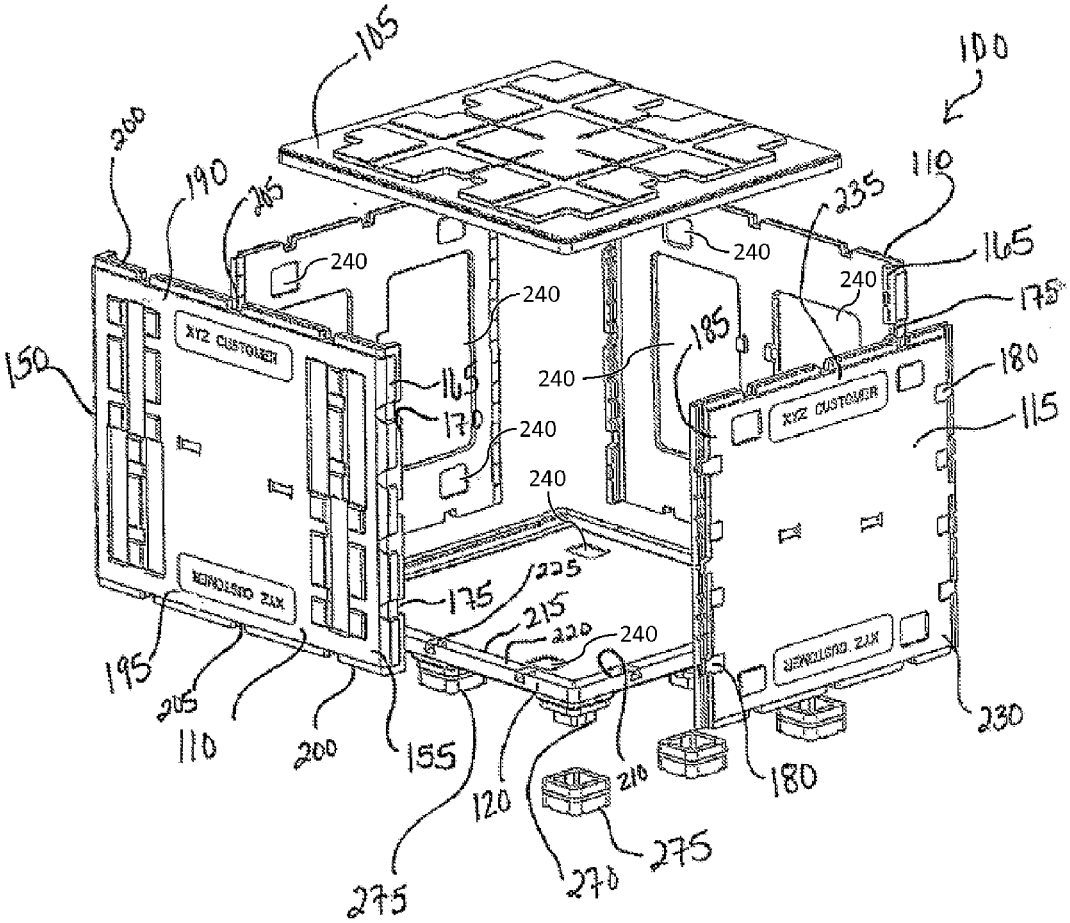
FIG. 3 is an exploded view of the embodiment shown in FIG. 1.

To that end, each support panel 110 may include rounded edges at each vertical side 150 and 155. The vertical sides 150 and 155 are configured to mate with the corresponding flat panel 115, as shown in FIG. 3. In this embodiment, the rounded edges of the vertical sides 150 and 155 each terminate in a rounded edge lip 165. Rounded edge lips 165 of each support panel 110 extend toward the rounded edge lips 165 of the opposite support panel 110 when the container 100 is in an assembled configuration. The rounded edge lips 165 may further include one or more notches 170 and recesses 175 that are configured to mate with corresponding notches 180 on the vertical sides 185 of the flat panels 115.

In this embodiment, the corresponding notches 180 protrude slightly from the end of the vertical side walls 185 of the flat panels 115 and are configured to fit within the recesses 175 along the vertical sides 150 and 155 of the support panels 110. Similarly, the vertical side walls 185 of the flat panels 115 have a thickness that is less than the thickness of the rest of the flat panels 115, enabling the user to insert a vertical side wall 185 of a flat panel 115 into the rounded edge lip 165 of a support panel 110.

The support panels 110 further include an upper surface 190 and a lower surfaces 195. The upper surface 190 and the lower surface 195 are configured to mate with either the base 120 or lid panel 105. As shown in FIG. 3, the upper surface 190 and the lower surface 195 include notches 200 and recesses 205 that are similar to the notches 170 and recesses 175 disposed along the vertical sides 150 and 155 of the support panel 110. In one embodiment, the upper surface 190 and lower surface 195 each have four notches 200 and three recesses 205 spaced evenly across each surface. The notches 200 may be beveled when formed so that the side walls of the notches 200 are not perpendicular to the horizontal plane of the upper surface 190 and lower surface 195. In other embodiments the notches 200 may take other configurations, including but not limited to a slit or a rounded cut out and may be spaced unevenly across each surface.

As shown in FIGS. 2 and 3, the base 120 includes an outer side wall 210 and an inner side wall 215, which together form a channel 220. In one embodiment, the channel 220 includes three evenly spaced apart protrusions 225 that are configured to mate with the recesses 205 disposed within the lower surface 195 of each support panel 110. When assembled the notches 200 on the lower surface 195 of the side wall 110 may be disposed within the channel 220 of the base 120 and held in place by fitting the protrusions 225 in the channel 220 within the recesses 205 of the side wall 110. A similar configuration may be used to secure the lower surface 230 of the flat panel 115 to the base 120 and the lid panel 105 to the upper surface 190 of the support panel 110 and the upper surface 235 of the flat panel 115.

On the interior surfaces of support panels 110 and the flat panels 115, there may be one or more storage recess(es) 240. As shown in FIGS. 2 and 3, the storage recesses 240 can be formed into the support panels 110 and the flat panels 115 to increase the capacity of the container 100. The storage recesses 240 may also be configured to mate with other storage recesses 240 when the support panels 110 and the flat panels 115 are in a collapsed or nested configuration. It is anticipated that storage recesses 240 may alternatively not be included in the support panels 110 without departing from the scope of the present invention.

Figure 4:
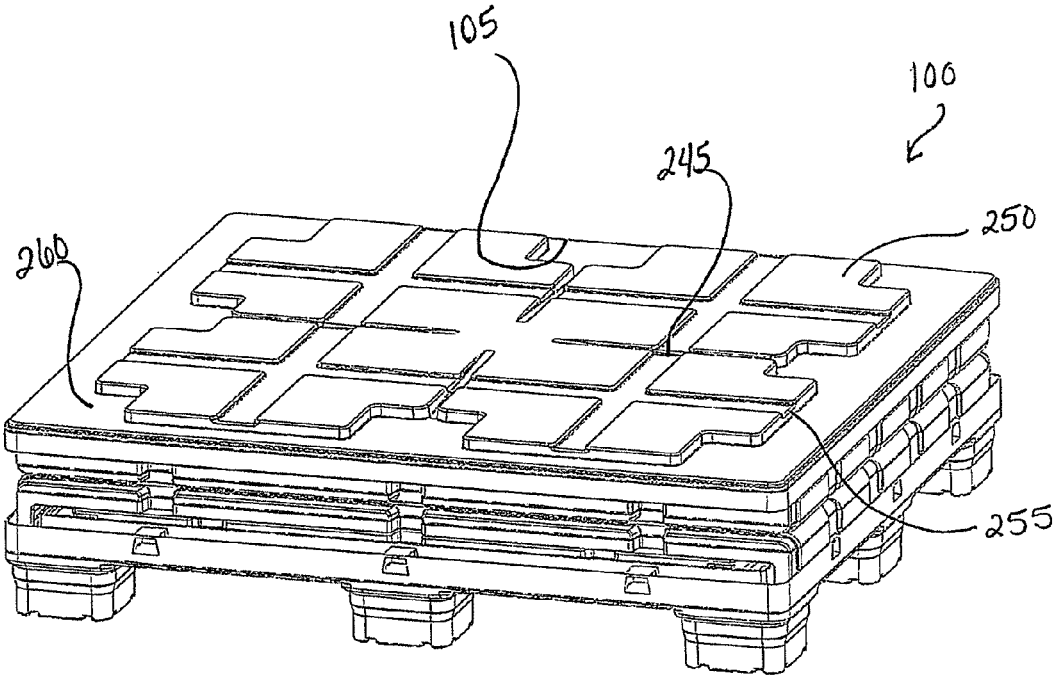
FIG. 4 is a perspective view of one embodiment of a collapsible nestable container in a disassembled and nested configuration.
Figure 5:
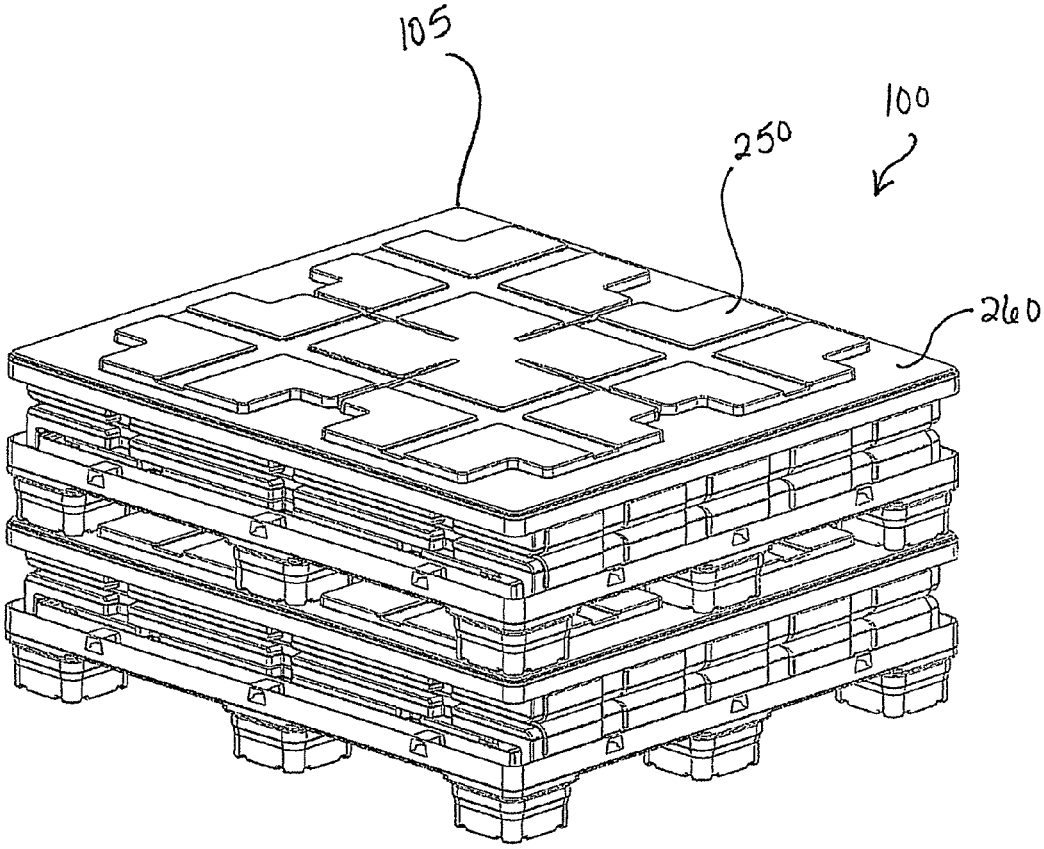
FIG. 5 is a perspective view of two disassembled and nested containers stacked with each other.

FIGS. 4 and 5 show one embodiment of the container 100 in a collapsed, nested configuration. As shown in FIG. 4, the lid panel 105 may have one or more water drain grooves 245 disposed on its upper surface to facilitate the drainage of liquid from the lid panel 105. The water drain grooves 245 may have angled bottom portions so that liquid may flow towards the edges of the lid panel 105. In the embodiment shown in FIG. 4, the water drain grooves 245 are perpendicular to the edges of lid panel 105. It is anticipated that other configurations of water drain grooves 245 are possible without departing from the scope of the present invention.

Figure 7:
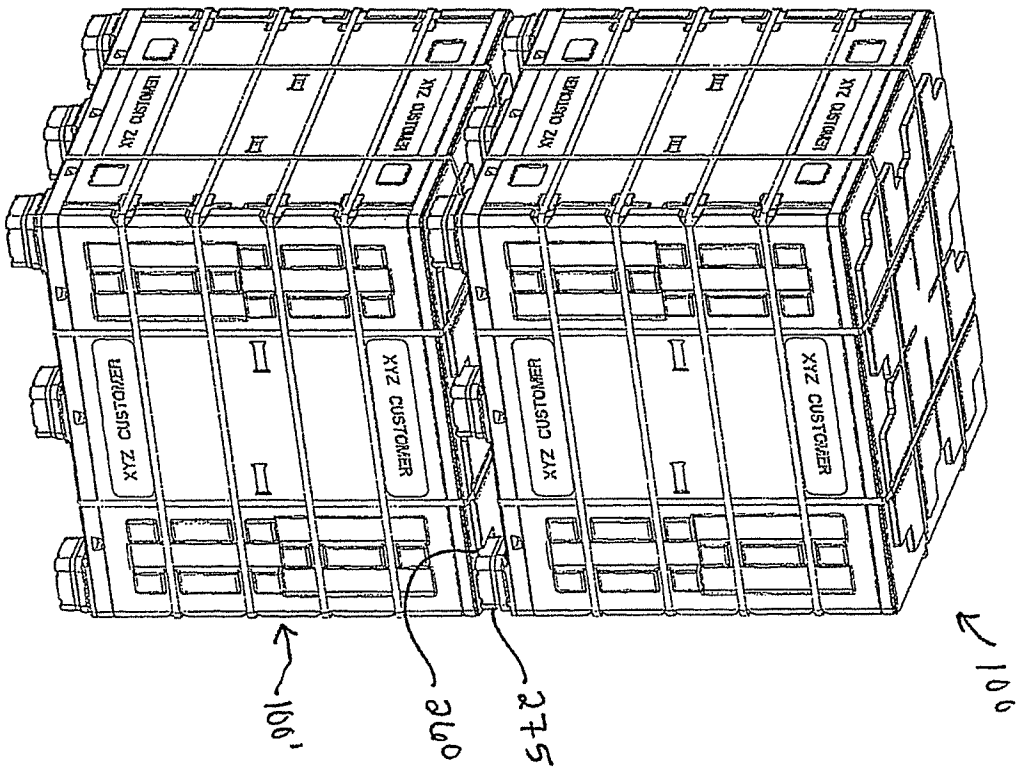
FIG. 7 is a perspective view of two assembled collapsible nestable containers stacked with each other.

As also shown in FIG. 4, the lid panel 105 may further include a raised lid surface 250 thereon. The raised lid surface 250 may include a plurality of polygonal shapes that define the water drain groves 245, banding recesses 255, and a plurality of foot recesses 260. As shown in FIG. 5, the foot recesses 260 facilitate stability when the containers 100 are stacked on each other in a collapsed configuration or in an assembled configuration, as shown in FIG. 7. It is anticipated that a different number of variously shaped raised lid surfaces 250 and foot recesses 260 may be used without departing from the scope of the present invention.

Referring again to FIG. 3, the base 120 may include one or more pallet feet connectors 270 supporting one or more pallet feet 275. The pallet feet connectors 270 may engage the pallet feet 275 via snap-fit connections, mechanical fasteners such as screws or bolts, chemical fasteners, or alternatively may be integrated with pallet feet 275.

Referring to FIG. 6, the base 120 may further comprises one or more angled edges 280 on a bottom side thereof. The angled edges 280 may guide forklift prongs underneath the base 120 and in between the pallet feet 275. In one embodiment, two angled edges 280 are provided between the pallet feet 275. Other configurations are anticipated without departing from the scope of the present invention.

Figure 8:
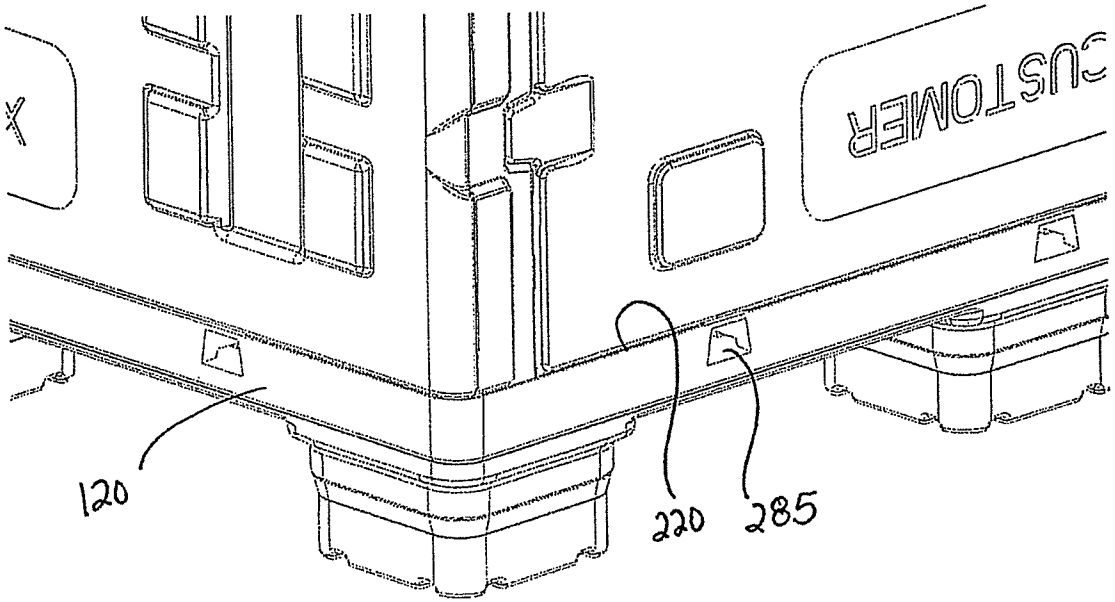
FIG. 8 is a detail view of one embodiment of an assembled pallet foot.

As shown in FIG. 8, drainage ports 285 may be provided along the edges of base 120 to facilitate fluid drainage. When assembled, fluid or condensation may build up on the outside or within the container 100. The drainage ports 285 allow the fluid build-up to shed down the container 100 from the outside, collect in the channel 220, and drain out of the container. Similarly, any fluid build-up on the inside surfaces of the container is able to drain out of the container from the inside. In this way, water build-up from either the inside or outside surfaces is prevented from forming bacteria or mold on the container 100.

Figure 9:
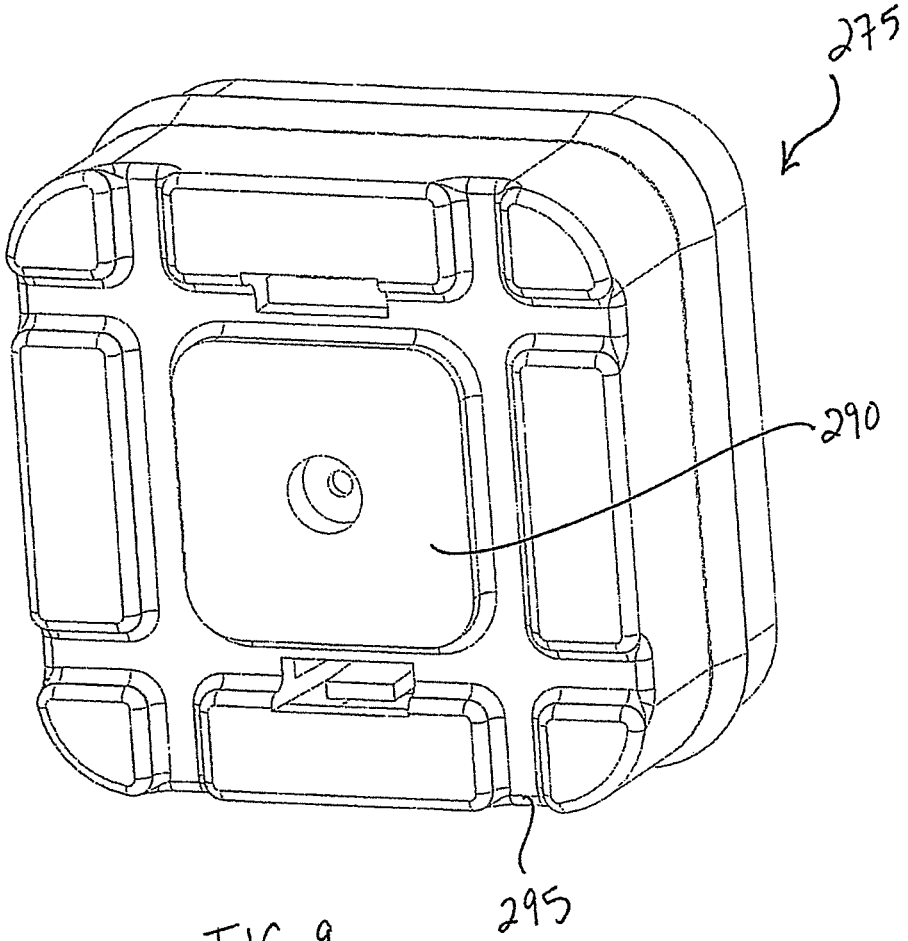
FIG. 9 is a perspective view of one embodiment of a pallet foot.
Figure 10:
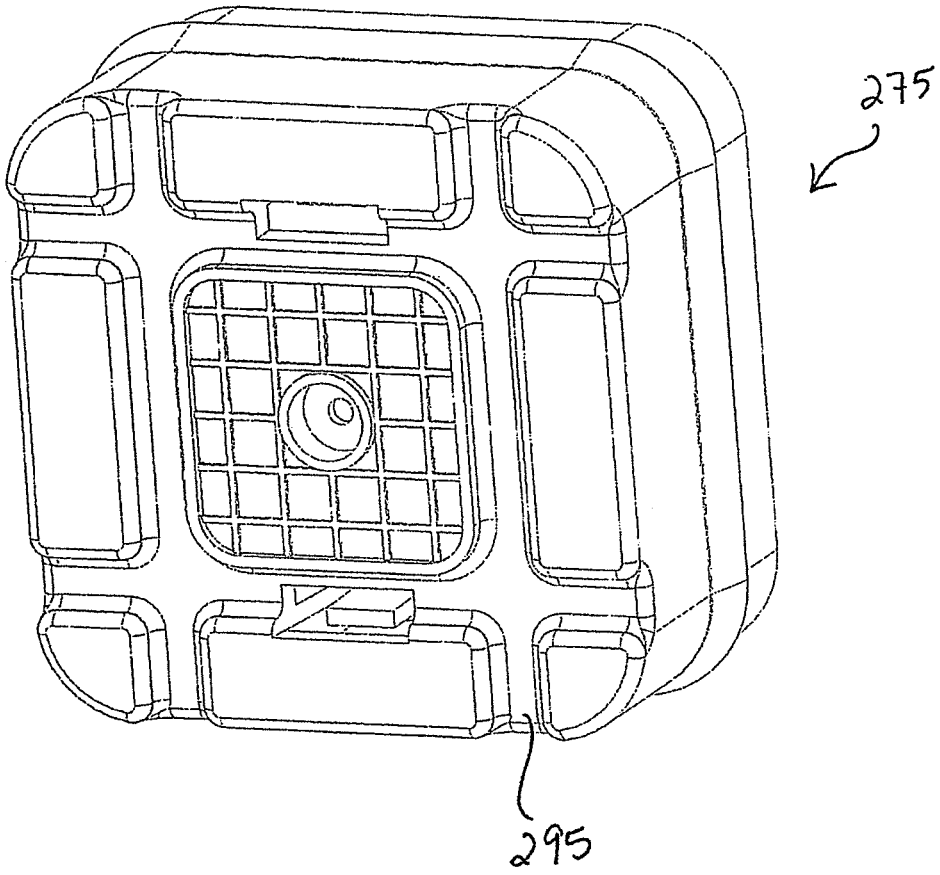
FIG. 10 is a perspective view of one embodiment of a pallet foot.

As shown in FIGS. 9 and 10, the pallet feet 275 may include anti-slip rubber bottom 290 feet grooves 295. The feet grooves 295 are configured to fit on to the inner wall 215 that forms part of the channel 220 on the base 120, providing stability when stacking one base 120 on top of the other.

Figure 11:
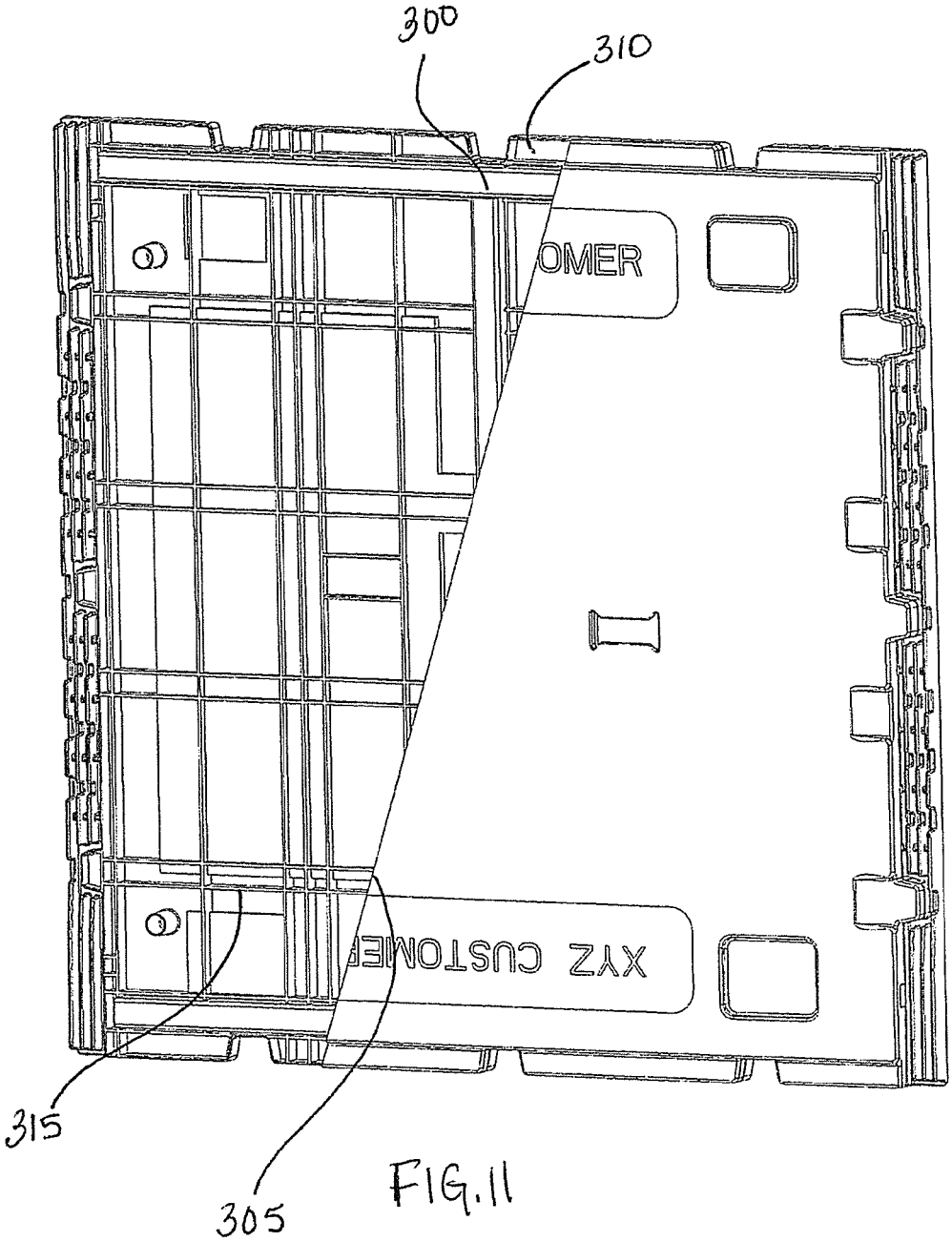
FIG. 11 is a cutaway view of one embodiment of a flat panel.

Each panel may be formed by permanently welding each panel together to capture a support structure 300 or similar reinforcement piece, such as steel beam or a high strength protruded fiberglass bar, between a first panel half 305 and a second panel half 310, forming a completed panel as shown in FIG. 11. The panel halves 305 and 310 may form ribs 315 between them when welded together. The panel halves 305 and 310 and ribs 315 may be formed of a plastic material, such as polypropylene or polyethylene, using any suitable molding process. When the panel halves 305 and 310 are welded together, the ribs 315 are heated and then joined to create a finished panel with a smooth exterior and interior surface. While FIG. 11 shows a flat panel 115 that has been cut away to depict the inner structure, it should be understood that the support panel 110, lid panel 105, or the base 120 may be constructed in a similar manner.

The ribs 315 may run either vertically or horizontally between the halves 305 and 310 of the panel. The support structure 300 disposed between the panel halves 305 and 310 provides rigidity, robustness, and strength to the flat panel 115. In this embodiment, the support structure 300 is in an "I" shape, but other arrangements of support structure 300 are anticipated without departing from the scope of the present invention. It is contemplated that the support structure 300 may be formed in any suitable shape and from any suitable material, such as steel, without deviating from the scope of the invention.

Figure 12:
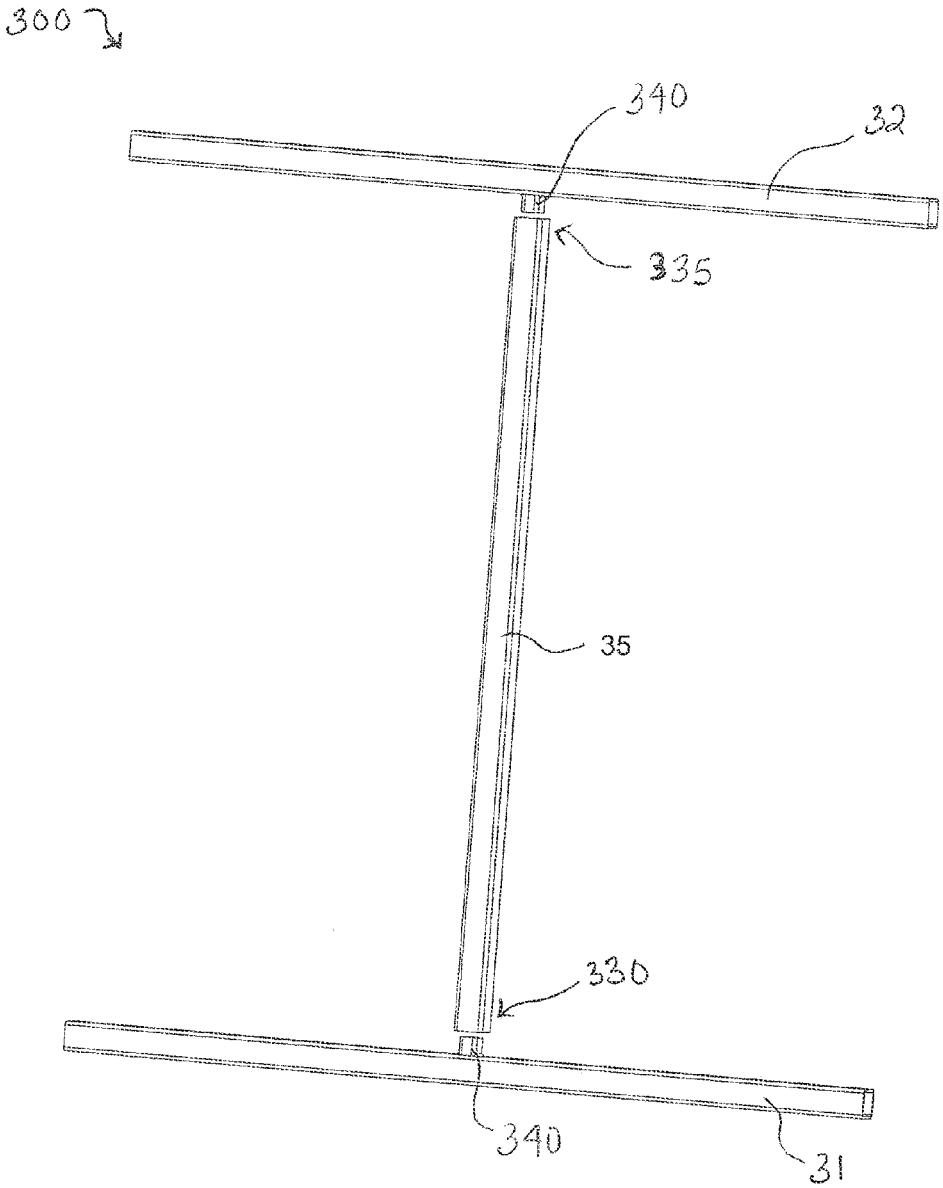
FIG. 12 is an exploded view of one embodiment of a support structure.

As shown in FIG. 12, in one embodiment, the support structure 300 includes at least a first horizontal beam 31, a second horizontal beam 32, and a vertical beam 32—forming an "I" beam configuration. The first horizontal beam 31 may be connected to a first end portion 330 of the vertical beam 35 and the second horizontal beam 32 may be connected to a second end portion 335 of the vertical beam 35 in order to prevent movement of the vertical beam 35 with respect to the first and second horizontal beams 31 and 32 in the z-axis (Z) direction.

It should be appreciated that any suitable means of connecting the three beams is contemplated, however, in one embodiment, the first and second horizontal beams 31 and 32 may include a connection member 340 that is welded along the y-axis (Y), extending perpendicularly from the horizontal beams. The connection member(s) 340 may be made of any suitable material, but in one example may be made of a section of steel tube similar to those used for the support structure 300, but having a smaller cross-section so that the connection member 340 may be fitted within the inner surface of either end of the vertical beam 35. In one embodiment, the connection member 340 is configured to allow some movement of the hollow vertical beam 35 along the x and y-axes, relative to the horizontal beams 31 and 32, but not in along the z-axis.

Another embodiment includes a method for assembling the container 100. Each component of the container 100 is designed to be interchangeable so that, for example, if a lid panel 105 becomes damaged or unusable, any other lid panel 105 can be provided to replace it. All panels and pallet feet are similarly designed. When the container 100 is in an assembled configuration, as shown in FIG. 1 and as described above, the surfaces of the panels may be generally flush with one another, with bands 125 located within banding recesses 130.

Another embodiment includes a method for storing and transporting the container 100 in a collapsed configuration. In this embodiment, the panels of each individual container may be configured to be nested with one another to provide a compact assembly, as shown in FIGS. 4 and 5.

As shown in FIG. 6, the lid panel 105 is stacked with its interior surface adjacent to the exterior surface of a first flat panel 115. In this configuration, the rounded edge lip notches 170 and recesses 175 on the support panels 110 may mate with lid tabs 320 (as shown in FIG. 13*a*) to secure the lid panel 105 to the rest of the container 100 when collapsed. The first flat panel 115 is then stacked with its interior surface adjacent to the interior surface of the first support panel 110. Protrusions (as shown in FIGS. 1, 3, 6, 8, 11 and 15) on the interior surface of the flat panel 115 may be configured to mate with storage recesses 240 of the support panel 110.

The first support panel 110 is then stacked with its exterior surface facing the exterior surface of a second support panel 110'. In this orientation, the nesting protrusions 130 of the first support panel 110 may be configured to mate with the nesting recesses 160' of the second support panel 110' and vice versa.

The interior surface of the second support panel 110' is then stacked facing the interior surface of a second flat panel 115'. Finally, the second flat panel 115' may be stacked with its exterior surface adjacent the interior surface of the base 120. The flat panel 115 may be dimensioned to fit within sloped edges 325 (See FIG. 6) created by the inner wall 215 of the base 120.

In yet another embodiment, each panel may be nested with other panels of the same type, as shown in FIGS. 13-16. FIG. 13 shows multiple lid panels 105 stacked on one another so that the outer lip of a first lid panel 105 fit within the outer recess around the top of a second lid panel 105' to prevent the lip panels 105 from moving relative to one another.

Figure 14:
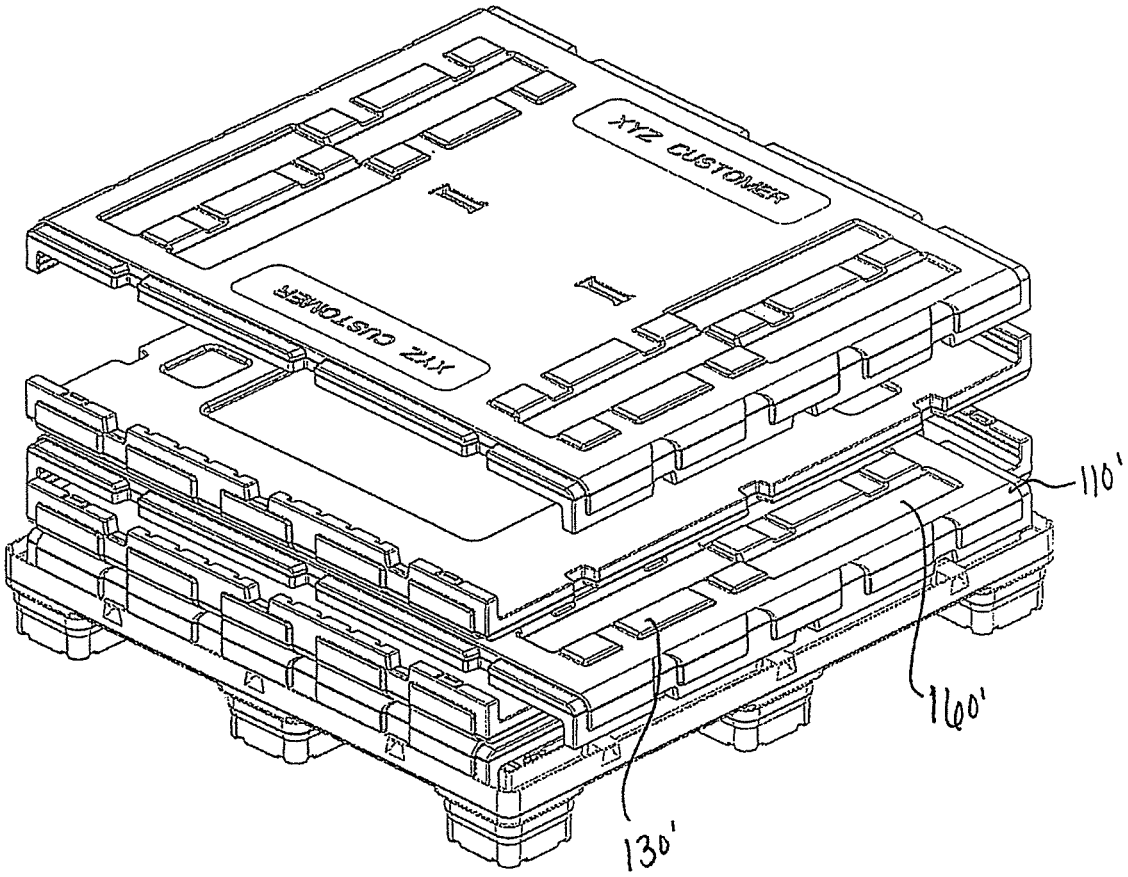
FIG. 14 is a perspective view of five support panels nested with each other on the base.
Figure 15:
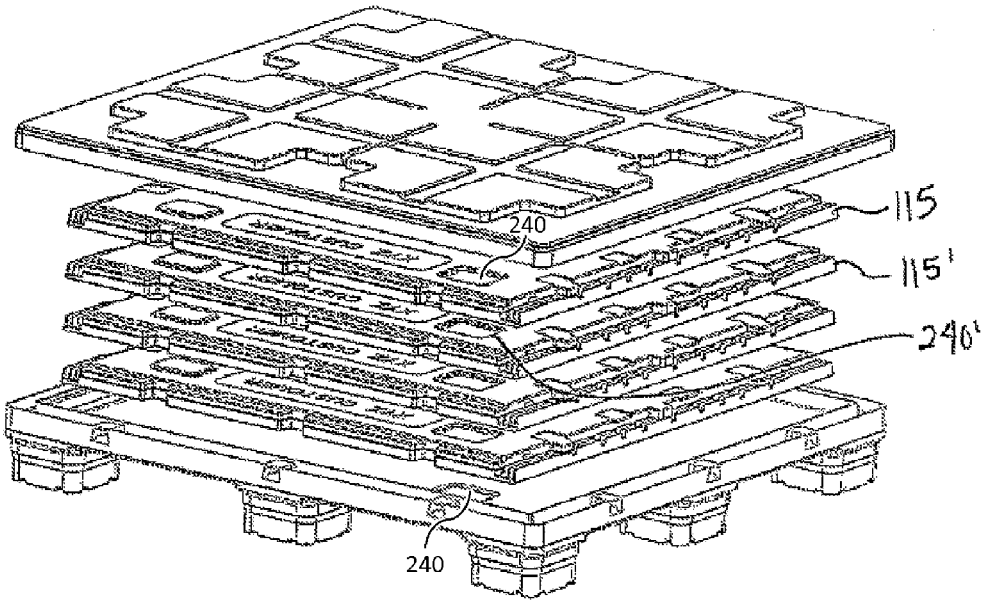
FIG. 15 is a perspective view of four flat panels nested with each other with the base and the lid panel.
Figure 16:
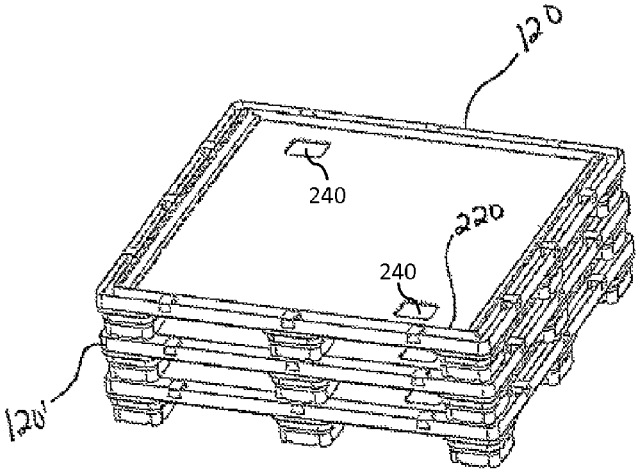
FIG. 16 is a perspective view of three bases nested with each other.
Figure 16A:
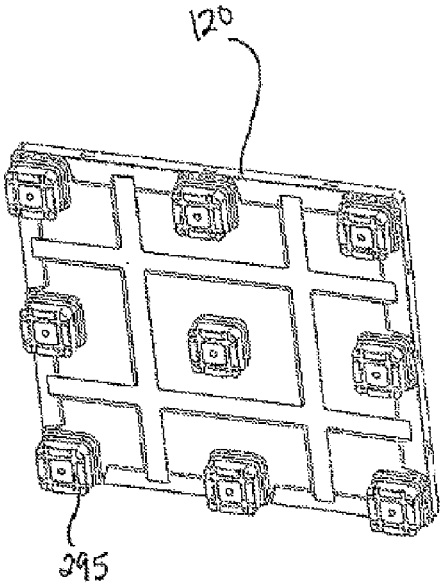
FIG. 16*a* is a perspective view of a bottom surface of a base.

As shown in FIG. 14, multiple support panels 110 may be nested upon one another. In this configuration the support panels are oriented so that the nesting protrusions 130 of a first support panel 110 sit within the nesting recesses 160' of a second support panel 110' and vice versa. As shown in FIG. 15, the flat panels 115 may be stacked on one another, with protrusions (as shown in FIGS. 1, 3, 6, 8, 11 and 15) of a first flat panel 115 disposed within storage recesses 240' of a second flat panel 115'. As shown in FIGS. 16 and 16*a*, multiple bases 120 may nest with one another, with pallet feet grooves 295 mating with the inner wall of the channel 220. It should be noted that all of the panels can be turned upside down or from one side to another in a 180° turn and still interlock with like panels.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present disclosure has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the disclosure, in its broader aspects, is not limited to the specific details, the representative apparatus and method, and illustrative examples shown and described. Accordingly, departures may be made from such details without departing from the spirit or scope of the applicant's general inventive concept.

What is claimed is:

1. A collapsible nestable container comprising:

a plurality of panels configured to interlock with each other, wherein the plurality of panels comprises a lid panel, a base, and additional panels;

the plurality of panels each comprising at least one locking feature that mates with the locking features on the other panels to form a locked connection in an assembled configuration; and the plurality of panels each comprising at least one nesting feature, wherein the at least one nesting feature of the lid panel and the at least one nesting feature of the base is configured to mate and form a locked connection with the at least one nesting feature of at least one of the additional panels in a collapsed configuration.

2. A collapsible nestable container comprising:

a plurality of panels comprising at least a first support panel, a second support panel, a first flat panel, a second flat panel, a lid panel, and a base;

wherein the plurality of panels each comprises at least one nesting feature;

wherein the first support panel, the second support panel, the first flat panel, and the second flat panel are configured to be disposed between the base and the lid panel to form an assembled configuration;

wherein movement of the plurality of panels is restricted with respect to the other panels when the plurality of panels are in the assembled configuration;

wherein the first support panel, the second support panel, the first flat panel, the second flat panel, the lid panel, and the base are configured to be nestable with respect to the rest of the plurality of panels in a collapsed configuration; and wherein the nesting features mate and lock to restrict movement of the plurality of panels with respect to the other panels when the plurality of panels are in the collapsed configuration.

3. The collapsible nestable container of claim 2, wherein the nesting features are further configured to mate with nesting features of like panels to form a locked connection thereto.

4. The collapsible nestable container of claim 3, wherein the first support panel and the second support panel are configured to be nestable stacked on one another and are further configured to be nestably stacked between the base and the lid panel.

5. The collapsible nestable container of claim 4, wherein the first flat panel and the second flat panel are configured to be nestably stacked on one another and are further configured to be nestably stacked between the base and the lid panel.

6. The collapsible nestable container of claim 5, wherein the base is configured to be nestably stacked on top of the lid panel.

7. The collapsible nestable container of claim 6, wherein each of the plurality of panels each comprise a first panel half, a second panel half, and a support structure.

8. The collapsible nestable container of claim 7, wherein the support structure comprises a first horizontal beam, a second horizontal beam, and at least one vertical beam having a first end portion and a second end portion; and wherein the first horizontal beam is connected to the first end portion of the at least one vertical beam and the second horizontal beam is connected to the second end portion of the at least one vertical beam.

9. A collapsible nestable container comprising:

a plurality of panels each comprising a first panel half, a second panel half, and a support structure, wherein the plurality of panels comprises a lid panel, a base, and additional panels, and wherein the plurality of panels are configured to interlock with each other;

the plurality of panels each comprising at least one locking feature that mates with the locking features on the other panels to form a locked connection in an assembled configuration;

the plurality of panels each comprising at least one nesting feature, wherein the at least one nesting feature of the lid panel and the at least one nesting feature of the base is configured to mate and form a locked connection with the at least one nesting feature of at least one of the additional panels in a collapsed configuration.

10. The collapsible nestable container of claim 9, wherein the support structure comprises a first horizontal beam, a second horizontal beam, and at least one vertical beam having a first end portion and a second end portion; and wherein the first horizontal beam is connected to the first end portion of the at least one vertical beam and the second horizontal beam is connected to the second end portion of the at least one vertical beam.

11. A collapsible nestable container comprising:

a plurality of panels comprising at least a first support panel, a second support panel, a first flat panel, a second flat panel, a lid panel, and a base, each panel further comprising a first panel half that forms an exterior surface, a second panel half that forms an interior surface, and a support structure disposed between the exterior surface and the interior surface;

wherein the first support panel, the second support panel, the first flat panel, and the second flat panel are configured to be disposed between the base and the lid panel to form an assembled configuration;

wherein movement of the plurality of panels is restricted with respect to the other panels when the plurality of panels are in the assembled configuration; and wherein the first support panel, the second support panel, the first flat panel, the second flat panel, the lid panel, and the base are configured to be nestable with respect to the rest of the plurality of panels in a collapsed configuration and each of the first support panel, the second support panel, the first flat panel, the second flat panel, the lid panel, and the base comprises at least one nesting feature that is configured to mate and form a locked connection with the nesting feature of another panel of the plurality of panels.

12. The collapsible nestable container of claim 11, wherein the first support panel and the second support panel are configured to be nestably stacked on one another and are further configured to be nestably stacked between the base and the lid panel.

13. The collapsible nestable container of claim 12, wherein the first flat panel and the second flat panel are configured to be nestably stacked on one another and are further configured to be nestably stacked between the base and the lid panel.

14. The collapsible nestable container of claim 13, wherein the base is configured to be nestably stacked on top of the lid panel.

15. The collapsible nestable container of claim 11, wherein the support structure comprises a first horizontal beam, a second horizontal beam, and at least one vertical beam having a first end portion and a second end portion; and wherein the first horizontal beam is connected to the first end portion of the at least one vertical beam and the second horizontal beam is connected to the second end portion of the at least one vertical beam.

* * * * *